US007395814B1

(12) United States Patent
Doepke et al.

(10) Patent No.: US 7,395,814 B1
(45) Date of Patent: Jul. 8, 2008

(54) ELECTRONIC VOLTAGE REGULATION FOR A MARINE RETURNLESS FUEL SYSTEM

(75) Inventors: Luke A. Doepke, Fond du Lac, WI (US); Michael A. Torgerud, Mt. Calvary, WI (US); Troy J. Kollmann, Mt. Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 47 days.

(21) Appl. No.: 11/518,696

(22) Filed: Sep. 11, 2006

(51) Int. Cl.
*F02M 55/02* (2006.01)

(52) U.S. Cl. ..... 123/497

(58) Field of Classification Search ..... 123/497
See application file for complete search history.

(56) References Cited

U.S. PATENT DOCUMENTS

| | | | | | |
|---|---|---|---|---|---|
| 4,926,829 | A * | 5/1990 | Tuckey | 123/497 |
| 5,004,344 | A * | 4/1991 | Tazartes et al. | 356/459 |
| 5,148,792 | A * | 9/1992 | Tuckey | 123/497 |
| 5,284,119 | A * | 2/1994 | Smitley | 123/497 |
| 5,355,859 | A * | 10/1994 | Weber | 123/497 |
| 5,406,922 | A * | 4/1995 | Tuckey | 123/497 |
| 5,411,002 | A * | 5/1995 | Smitley | 123/497 |
| 5,673,670 | A | 10/1997 | Powell et al. | 123/463 |
| 5,727,515 | A * | 3/1998 | Biester | 123/198 D |
| 5,752,490 | A | 5/1998 | Rodgers et al. | 123/497 |
| 5,927,253 | A | 7/1999 | Oyafuso et al. | 123/456 |
| 5,997,262 | A | 12/1999 | Finkbeiner et al. | 417/410.4 |
| 6,095,763 | A | 8/2000 | Bodzak et al. | 417/295 |
| 6,099,263 | A | 8/2000 | Bodzak et al. | 417/295 |
| 6,296,458 | B1 | 10/2001 | Zacher et al. | 417/366 |
| 6,318,344 | B1 | 11/2001 | Lucier et al. | 123/516 |
| 6,357,423 | B1 * | 3/2002 | Kanno | 123/497 |
| 6,453,877 | B1 * | 9/2002 | Lucier et al. | 123/497 |
| 6,553,974 | B1 | 4/2003 | Wickman et al. | 123/516 |
| 6,575,145 | B2 | 6/2003 | Takahashi | 123/519 |
| 6,694,955 | B1 | 2/2004 | Griffiths et al. | 123/516 |
| 6,698,401 | B2 * | 3/2004 | Suzuki et al. | 123/516 |
| 6,925,990 | B1 | 8/2005 | Konopacki | 123/497 |
| 6,971,374 | B2 | 12/2005 | Saito | 123/516 |
| 2002/0083923 | A1 * | 7/2002 | Suzuki et al. | 123/464 |
| 2002/0148445 | A1 * | 10/2002 | Doane et al. | 123/458 |

OTHER PUBLICATIONS

Pursifull, Ross. (2006). *Fuel Rail Pressure Relief* (SAE Technical Paper Series, 2006-01-0626). SAE International.
U.S. Appl. No. 11/290,013, filed Nov. 30, 2005, Konopacki.

* cited by examiner

*Primary Examiner*—Thomas N Moulis
(74) *Attorney, Agent, or Firm*—William D. Lanyi

(57) ABSTRACT

A fuel system for a marine propulsion device controls the pressure of liquid fuel within a fuel rail by altering the pump speed of a fuel pump. The fuel pressure in the rail is measured by a pressure transducer which provides an output signal to a microprocessor that allows the microprocessor to select an operating speed for the fuel pump that conforms to a desired fuel pressure in the rail. By decreasing or increasing the operating speed of the positive displacement fuel pump as a function of the measured pressure in the rail, the microprocessor can accurately regulate the fuel pressure.

20 Claims, 3 Drawing Sheets

ELECTRONIC VOLTAGE REGULATION FOR A MARINE RETURNLESS FUEL SYSTEM

BACKGROUND OF THE INVENTION

1. Field of the Invention

The present invention relates generally to a returnless fuel system for a marine propulsion device and, more particularly, to a fuel system that regulates fuel pressure within a fuel rail and controls the speed of a fuel pump motor in order to maintain a desired pressure within the fuel rail.

2. Description of the Related Art

U.S. Pat. No. 5,673,670, which issued to Powell et al. on Oct. 7, 1997, describes a returnless fuel delivery system. A series-pass fuel pressure regulator in the system provides fuel of a regulated pressure to a fuel rail comprising at least one fuel injector. A bypass fuel pressure regulator provides fuel with a regulated pressure to the series-pass regulator. An in-line fuel filter is located downstream from the bypass regulator, such that only the fuel which reaches the series-pass regulator is filtered. A check valve is located downstream from the bypass regulator as well, to prevent fuel pressure bleed-down through the fuel pump and bypass regulator. A pressure relief valve is coupled to allow fuel with a pressure above a predetermined value to flow around the check valve.

U.S. Pat. No. 5,752,490, which issued to Rodgers et al. on May 19, 1998, describes a returnless fuel injection system for use with an internal combustion engine. The fuel system has a fuel pump, a throttle position sensor for sensing the power requested, and an engine control unit. The improvement comprises a fuel pump control circuit using three distinct duty cycle modulator circuits to control fuel pump speed.

U.S. Pat. No. 5,927,253, which issued to Oyafuso et al. on Jul. 27, 1999, describes a fuel system priming method. The method is intended for use with a returnless fuel system and electronic fuel injection. It includes the steps of sensing fuel pressure rate of rise during priming. A fuel pump is first activated to pressurize the system and then the injectors are controlled for a short interval in response to the sensed rate of pressure rise to vent trapped air in the fuel system.

U.S. Pat. No. 5,997,262, which issued to Finkbeiner et al. on Dec. 7, 1999, describes screw pins for a gear rotor fuel pump assembly. An in-tank type of electric motor fuel pump with a fuel inlet end cap, a fuel outlet cap, a case coaxially joining the end caps to form a pump housing, an electric motor mounted in the housing having a stator with spring-retained permanent field magnets surrounding the motor armature, and a gerotor pump in the housing rotatably driven by the motor armature is described.

U.S. Pat. No. 6,095,763, which issued to Bodzak et al. on Aug. 1, 2000, describes a fuel delivery pump with a bypass valve for a fuel injection pump for an internal combustion engine. The pump system includes a pair of gears that mesh with each other and are driven to rotate in a pump chamber. The gears deliver fuel from an intake chamber connected to a storage tank, along a supply conduit that is formed between the end face of the gears and circumference wall of the pump chamber, into a pressure chamber connected to the fuel injection pump. A conduit is integrated into a housing of the fuel delivery pump and connects the intake chamber to the pressure chamber. The conduit can be opened by means of a pressure valve disposed in it, wherein the pressure valve is functionally connected to a throttle valve that throttles the fuel supply into the intake chamber as a function of the controlled pressure on the control valve via the pressure chamber.

U.S. Pat. No. 6,099,263, which issued to Bodzak et al. on Aug. 8, 2000, describes a fuel delivery pump with a bypass valve and an inlet check valve for a fuel injection pump for internal combustion engines. The pump has a pair of rotating displacing elements which deliver fuel from an intake chamber connected to a storage tank along a supply conduit that is formed between the end face of the rotating displacing elements and the circumference wall of the pump chamber into a pressure chamber connected to the fuel injection pump and with a bypass conduit which is integrated into a housing of the fuel delivery pump and connects the intake chamber to the pressure chamber and which is opened by means of a pressure valve disposed in it, wherein the intake chamber is closed with a check valve that operates counter to the fuel delivery direction.

U.S. Pat. No. 6,296,458, which issued to Zacher et al. on Oct. 2, 2001, describes an electric fuel pump. The pump is intended for use with an internal combustion engine in which a pump mechanism is provided in a housing for pumping fuel from an inlet to an outlet of the housing. A DC motor in the housing is drivingly connected to the pump mechanism, the fuel flowing through is the housing past the motor to the outlet. A module including a commutation circuit for the DC motor is sealed in the housing from the fuel which flows therearound and cools the module.

U.S. Pat. No. 6,318,344, which issued to Lucier et al. on Nov. 20, 2001, describes a deadheaded fuel delivery system using a single fuel pump. The fuel pump draws fuel from a fuel tank via a fuel supply network or a fuel supply line, transfers the fuel through a fuel connector and a fuel filter, and delivers the fuel to a vapor separator.

U.S. Pat. No. 6,553,974, which issued to Wickman et al. on Apr. 29, 2003, discloses an engine fuel system with a fuel vapor separator and a fuel vapor vent canister. The system provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber.

U.S. Pat. No. 6,575,145, which issued to Takahashi on Jun. 10, 2003, describes a fuel supply system for a four-cycle outboard motor. The engine includes a fuel injection system that includes a fuel pump, a plurality of fuel injectors, and a vapor separator. The vapor separator is in communication with the fuel pump and at least one fuel return line. The separator includes a vent for removing vapors from the fuel. The vapor separator also includes a canister position within the vapor separator below the vent.

U.S. Pat. No. 6,694,955, which issued to Griffiths et al. on Feb. 24, 2004, discloses a marine engine with primary and secondary fuel reservoirs. The system comprises first and second fuel reservoirs connected in fluid communication with each other. The first fuel reservoir is a fuel vapor separator which has a vent conduit connected in fluid communication with a second fuel reservoir. Under normal conditions, fuel vapor flows from the fuel vapor separator and into the second fuel reservoir for eventual discharge to the atmosphere.

U.S. Pat. No. 6,925,990, which issued to Konopacki on Aug. 9, 2005, discloses a method for controlling fuel pressure for a fuel injected engine. A fuel pressure control system for a fuel injected engine measures the fuel pressure at an outlet of a fuel pump and controls the operating speed of the fuel pump as a function of the difference between a desired pressure and a measured pressure. Signals are provided to the fuel pump which are pulse width modulated signals that have a pulse width determined as a function of the desired pressure at the outlet of the pump. The desired pressure is determined as a function of air flow into the engine, a desired air/fuel ratio which, in turn, is a function of engine speed and the load on the engine, and a desired fuel rate which is determined as a function of the air/fuel ratio and the air flow into the engine. The desired fuel rate is then used to select a pressure at the outlet of the pump which will result in the desired fuel rate.

U.S. Pat. No. 6,971,374, which issued to Saito on Dec. 6, 2005, describes a fuel supply system for an outboard motor. A vapor separator venting system vents fuel vapor from a fuel vapor separator through a vapor relief valve. The vapor relief valve is located in a high position on the outboard motor to ensure that liquid fuel does not reach the vapor relief valve.

U.S. patent application Ser. No. 11/290,013, which was filed by Konopacki on Nov. 30, 2005, discloses a returnless fuel system module. A returnless fuel system module includes a fuel pump in a fuel pump cavity, a fuel pressure regulator in a fuel pressure regulator cavity, first and second transfer passages therebetween, and a heat exchanger integrally formed in the housing in thermally conductive relation with at least the bypass relief passage.

The patents described above are hereby expressly incorporated by reference in the description of the present invention.

A paper titled "Fuel Rail Pressure Relief", written by Ross Pursifull for the SAE technical paper series, discusses various fuel systems. It describes a major source of engine-off evaporative hydrocarbon emissions as being a result of fuel injector leakage. Methods and devices to relieve fuel rail pressure after key-off, and thus reduce leakage, are described in this paper. Impact on fuel manifold repressurization is also discussed. The basic principles governing this behavior, such as fuel thermal expansion, fuel vapor pressure, and dissolve gases in liquid, are described. Data is shown in this paper relating to fuel pressure relief.

Returnless fuel systems typically recirculate fuel, when more fuel is pumped to a fuel rail than is needed by the injectors connected to the fuel rail, by allowing a certain percentage of the pumped fuel to recirculate from the outlet of a fuel pump back to an inlet of the fuel pump or to a fuel reservoir. This recirculation of fuel requires energy to be expended and raises the temperature of the fuel that is recirculated. It would therefore be significantly beneficial if a fuel system could be provided which accurately maintains a desired pressure in the fuel rail without having to recirculate significant quantities of liquid fuel after it has been pressurized by the operation of a fuel pump.

SUMMARY OF THE INVENTION

The present patent application is generally related to copending application Ser. No. 11/518,813, which has been filed on the same date and assigned to the assignee of the present application.

A fuel system for a marine propulsion device, made in accordance with a preferred embodiment of the present invention, comprises a fuel rail connected in fluid communication with a plurality of fuel injectors, a fuel pump having an outlet connected in fluid communication with the fuel rail, a pressure sensor connected in fluid communication with the fuel rail, and a controller connected in signal communication with the pressure sensor. An inlet of the fuel pump is connectable in fluid communication with a fuel reservoir, such as a fuel tank, of a marine vessel which is displaced from the marine propulsion device. The fuel pump is connected to the fuel reservoir by a conduit which is extended between the fuel reservoir and the fuel pump. The controller is configured to control the operating speed of the fuel pump as a function of the pressure of fuel within the fuel rail as measured by the pressure sensor.

In a particularly preferred embodiment of the present invention, the controller comprises a microprocessor which is configured to determine a desired operating speed of the fuel pump as a function of the pressure of fuel within the fuel rail. A motor is connected in torque transmitting relation with the pump and the controller comprises a control module which is configured to receive a command signal from the microprocessor which is related to a desired operating speed of the pump and provide an output signal to the motor which is a function of that desired operating speed. In a particularly preferred embodiment of the present invention, the motor is a brushless motor and the fuel pump is a positive displacement pump. The positive displacement pump can be a screw pump, a gerotor pump or any other type of positive displacement pump that is applicable for use with the present invention. The fuel pump can be disposed under the cowl of an outboard motor at a higher elevation than the fuel reservoir or fuel tank. The fuel system is unvented between the fuel reservoir and the fuel rail. In other words, the fuel system can be sealed from the atmosphere between the fuel reservoir and the fuel rail.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
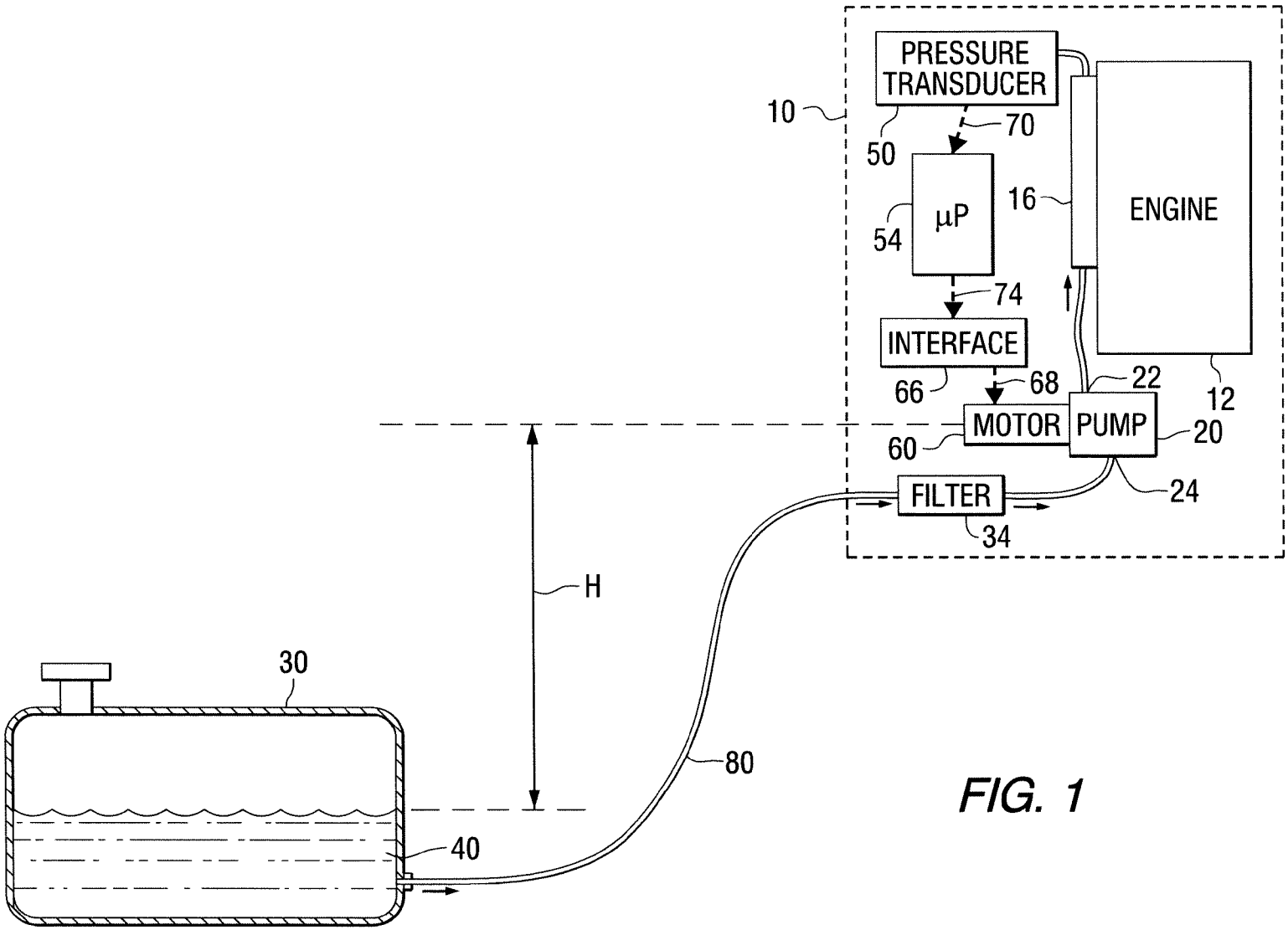
FIG. 1 is a schematic representation of a marine fuel system made in accordance with a preferred embodiment of the present invention.

Throughout the description of the preferred embodiment of the present invention, like components will be identified by like reference numerals.

FIG. 1 is a schematic representation of a fuel system for a marine engine which is made in accordance with a preferred embodiment of the present invention. A marine propulsion device is represented by the dashed box 10 and includes an engine 12 configured to drive a propulsor (not shown in FIG. 1) such as a propeller or impeller. A fuel rail 16 provides a fuel manifold for a plurality of fuel injectors (not shown in FIG. 1). Fuel flows from an internal cavity of the fuel rail 16, through the fuel injectors, and into the cylinders of the engine 12. A fuel pump 20 has an outlet 22 connected in fluid communication with the fuel rail 16. An inlet 24 of the fuel pump 20 is connectable in fluid communication with a fuel reservoir 30, or fuel tank. A filter 34 is shown connected in fluid communication between the fuel reservoir 30 and the pump 20, but it should be understood that the fuel filter 34 is not a necessary component in all embodiments of the present invention. The fuel reservoir 30, such as a fuel tank, stores liquid fuel 40 for use by the engine 12.

A pressure sensor 50 is connected in fluid communication with the fuel rail 16 to measure the pressure of fuel within the fuel rail 16. A controller is connected in signal communication with the pressure transducer 50. In a particularly preferred embodiment of the present invention, the controller comprises a microprocessor 54 which determines a desired operating speed of the pump 20 as a function of the pressure within the fuel rail 16 as measured by the pressure transducer 50. A motor 60 is connected in torque transmitting relation with the fuel pump 20 in a preferred embodiment of the present invention. The controller can comprise a control module 66, or interface, which is configured to receive a command signal from the microprocessor 54, which is related to a desired operating speed of the pump 20. The control module 66 provides a signal 68 to the motor 60 which causes the pump 20 to operate at the desired speed. The microprocessor, in a preferred embodiment of the present invention, receives the pressure related signal 70 from the pressure transducer 50 and determines an appropriate operating speed for the pump 20. This appropriate operating speed 74 is provided to the interface 66 in a preferred embodiment of the present invention.

With continued reference to FIG. 1, the motor 60 can be a brushless motor in a particularly preferred embodiment of the present invention. The pump 20 can be a positive displacement pump such as a screw pump or gerotor pump in a preferred embodiment of the present invention.

With continued reference to FIG. 1, the fuel pump 20 is shown at a higher elevation than the liquid fuel 40 within the fuel reservoir 30. This height differential is identified by arrow H in FIG. 1. In addition, it can be seen that the pump 20 is physically displaced from the fuel reservoir 30 and connected via a conduit 80. This physical displacement of the pump 20 from the fuel reservoir 30 distinguishes the fuel system of a marine propulsion device from known fuel systems associated with land vehicles, such as automobiles. Many known fuel systems place the pump 20 within the liquid fuel 40 of the fuel reservoir 30. When the pump is displaced from the reservoir, as shown in FIG. 1, the situation sometimes requires that the pump 20 draw liquid fuel through the conduit 80. This can represent a significant distance, depending on the length of the conduit 80 and the configuration of the marine vessel in which the fuel system is used. In addition, the pump 20 must be able to draw liquid fuel 40 from a location which is significantly lower than the inlet 24 of the pump. For these purposes, a positive displacement pump, such as a screw pump or gerotor pump, is advantageous.

An important attribute which distinguishes the present invention from fuel systems known to those skilled in the art is related to the fact that the microprocessor 54 electronically regulates the pressure of the fuel within the fuel rail 16 by moderating the speed of the pump 20 to maintain this fuel pressure at a desired magnitude.

Mechanical pressure regulators, used in conjunction with fuel rails, are known to those skilled in the art. In addition, variable speed pumps have been used to control the flow rate of liquid fuel from a fuel tank to a fuel rail, as described in U.S. Pat. No. 5,752,490. However, the present invention is distinguished from prior art fuel systems in several ways. Perhaps most importantly, the present invention regulates the pressure within the fuel rail 16 with a controller, such as the microprocessor 54 and interface 66, that controls the speed of the motor 60 and pump 20 as a function of the pressure within the fuel rail 16 as measured by the pressure transducer 50. It does not use a mechanical pressure regulator. In addition, the present invention does not control the speed of the pump 20 as a function of a throttle position sensor associated with the engine 12. The system described in U.S. Pat. No. 5,752,490, monitors the throttle position and controls the fuel pump as a function of the position of the throttle plate of the engine. In contradistinction to this approach, the present invention measures the pressure within the fuel rail 16 and controls the speed of the pump 20 so that the pressure within the fuel rail is maintained at a desired magnitude within an allowable tolerance.

Figure 2:
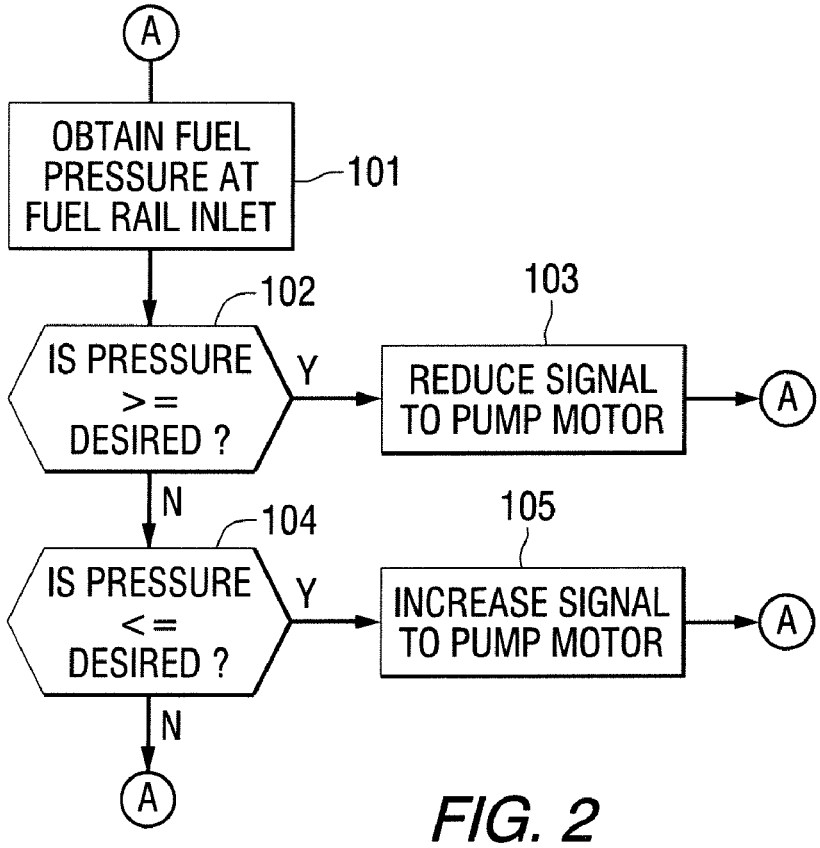
FIG. 2 is a simplified flowchart of one method of operating the fuel system of FIG. 1.

Several different techniques can be employed in conjunction with the present invention shown in FIG. 1 to maintain the pressure within the fuel rail 16. In FIG. 2, a simplified flowchart shows one of those techniques. After obtaining a fuel pressure measurement at the fuel rail inlet, as measured by the pressure transducer 50 and described at functional block 101 in FIG. 2, the microprocessor 54 determines whether or not the measured pressure is greater than or less than the desired magnitude. If it's greater than that magnitude, as determined at functional block 102, the pump speed is reduced as described at functional block 103 and the software returns to the beginning of the algorithm. If the pressure is not greater than the desired magnitude, it is determined whether the pressure is less than the desired magnitude at functional block 104. If it is, the pump speed is increased as represented at functional block 105. The simple routine illustrated in FIG. 2, maintains the pressure within the fuel rail 16 at a desired magnitude. Those skilled in the art are aware that the two comparisons described at functional blocks 102 and 104 would provide an appropriate tolerance band between upper and lower pressure control limits in a typical application.

Figure 3:
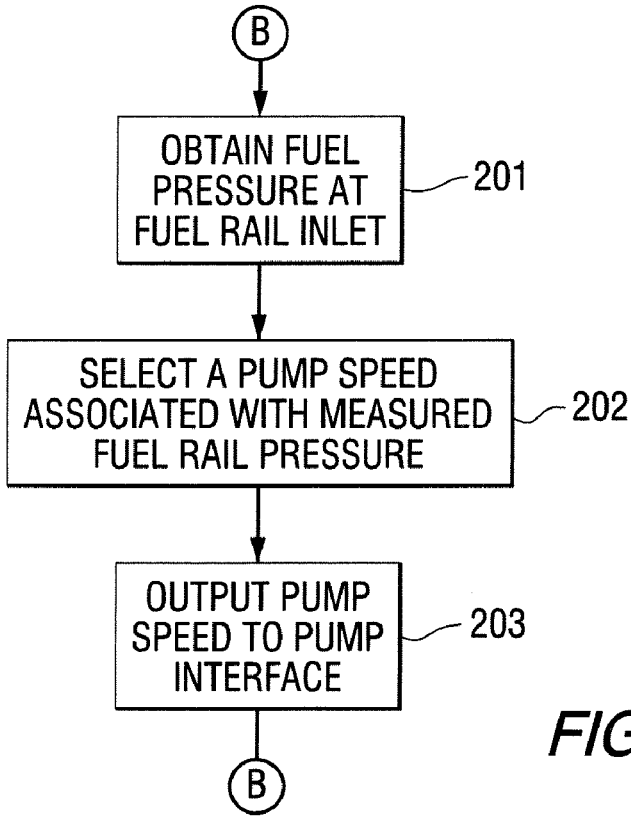
FIG. 3 is an alternative method for operating the fuel system shown in FIG. 1.

FIG. 3 shows a simplified procedure that could also be used in conjunction with the present invention. At functional block 201, the pressure of the fuel within the rail 16 is measured by the pressure transducer 50 and the microprocessor 54 selects a pump speed that is associated with the measured fuel pressure at functional block 202. In other words, the magnitude of the fuel pressure in the fuel rail 16 as measured by the pressure transducer 50, whether it is above or below the desired pressure, can be associated with a pump speed. In other words, measured pressures below the desired pressure would be associated with higher pump speeds used to correct that lower pressure and measured pressures above the desired fuel pressure in the rail 16 would be associated with lower pump speeds in order to cause the fuel pressure to be reduced to the desired magnitude. After the pump speed is selected at functional block 202, a signal is provided to the interface 66 as described in functional block 203.

With continued reference to FIGS. 1-3, it should be understood that the output on line 74 from the microprocessor would typically represent a pump speed that is determined by the microprocessor 54 from the pressure received on line 70 from the pressure transducer 50. The signal provided at the output of the interface 66, or control module, would typically be an electrical parameter associated with the motor 60 which causes the motor 60 to rotate at a speed which will result in the pump 20 operating at the speed identified on line 74. The function of the interface 66 is to convert a pump speed to an electrical parameter which causes the motor 66 to rotate the pump 20 at the speed commanded on line 74 from the microprocessor 54.

With continued reference to FIGS. 1-3, a particularly preferred embodiment of the present invention provides a brushless motor 60 that drives a positive displacement pump 20, such as a screw pump or gerotor pump. In addition, the positive displacement pump can be a vane pump. These types of pumps provide satisfactory lift capacity to overcome the differential in height H and a sufficient pressure at its outlet 22 to achieve the desired pressure of the fuel within the fuel rail 16. The system of the present invention is capable of satisfactorily drawing fuel through a conduit 80 from a fuel reservoir 30 which is remote from the pump 20. The system is non-vented between the fuel reservoir 30 and the outlet 22 of the pump 20. This is advantageous because environmental considerations are improved if fuel vapor is not vented to the atmosphere. The positive displacement characteristic of the pump 20 is significant because it is able to draw vapor through the fuel line 80 to avoid problems associated with vapor lock when the fuel system is operating at elevated temperatures.

Since the pump 20 of a preferred embodiment of the present invention is located above the fuel reservoir 30, by a distance represented by arrow H in FIG. 1, the fuel supply system must be able to draw gaseous fuel through line 80 and into the inlet of pump 20. This is particularly important when the engine 12 is being started after being turned off for a period of time.

Various types of fuel pumps are provided with bypass conduits that recirculate fuel from the outlet of the pump to the inlet of the pump. However, a bypass conduit can be significantly disadvantageous when used in conjunction with a marine engine application in which the fuel reservoir 30 is located below the height of the pump 20 and the pump is required to draw fuel vapor, or gaseous fuel, upwardly through a conduit 80. The present invention solves this problem by providing a check valve which prevents the recirculation of gaseous fuel but permits the recirculation of liquid fuel around the pump.

Figure 4:
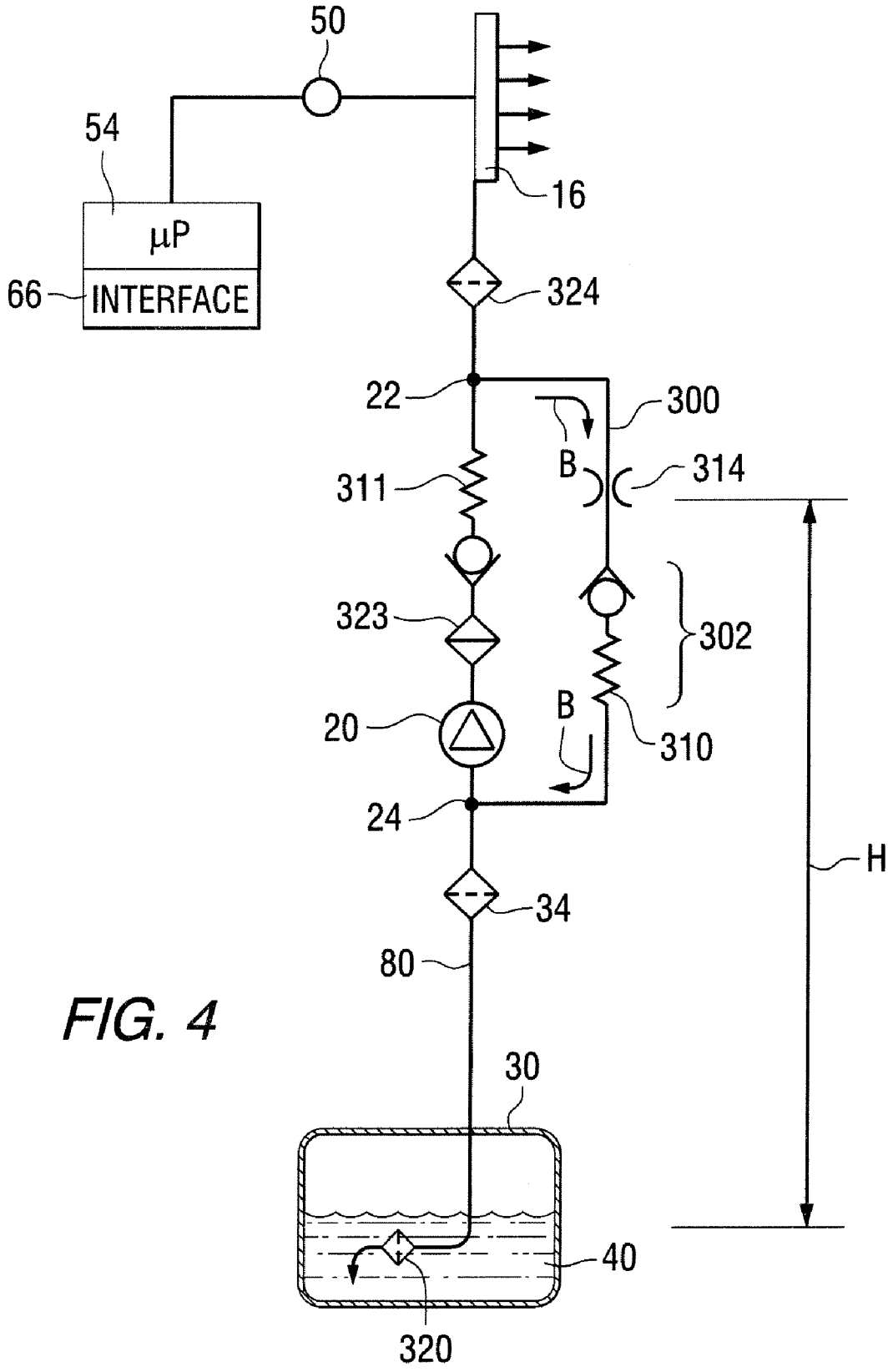
FIG. 4 is a schematic representation of a preferred embodiment of the present invention which incorporates a bypass conduit.

FIG. 4 is a simplified schematic representation of a preferred embodiment of the present invention. FIG. 4 is generally similar to FIG. 1 but with a bypass conduit 300 connected in fluid communication between the outlet 22 of the pump 20 and the inlet 24 of the pump 20. A check valve 302 is connected in fluid communication with the bypass conduit 300 and configured to prevent a bypass flow of fluid from flowing in the direction represented by arrows B unless the pressure at the outlet 22 of the pump 20 is greater than a predetermined pressure setting for the check valve 302. In a particularly preferred embodiment of the present invention, the check valve 302 is configured to prevent flow in the direction of arrows B unless the pressure at the outlet 22 is at least equal to the dry pump deadhead pressure of approximately 25 pounds/in$^2$ greater than the pressure at the inlet 24 of the pump 20. This pressure setting is typically determined by the spring constant of a spring 310 of the check valve 302. Another check valve 311 is also illustrated. It inhibits backflow through the pump 20. Between the outlet 22 of the pump 20 and the check valve 302, an orifice 314 is provided. The primary purpose of the orifice 314 is to minimize recirculated flow at system operating pressure while preventing pump stall by providing a recirculation flow path during periods of low fuel comsumption.

With continued reference to FIG. 4, when no liquid fuel is in the conduit 80 between the fuel reservoir 30 and the pump 20, the pump will draw gaseous fuel, or fuel vapor, and cause that fuel vapor to flow through the pump 20 to its outlet 22. If the fuel vapor is permitted to flow through the bypass conduit 300, the pump 20 will experience significant difficulty in drawing liquid fuel 40 from the reservoir 30. However, since fuel vapor is compressible, the pressure buildup in the conduit between the fuel pump 20 and the fuel rail 16 will be gradual and, as the vapor is pressurized in the region beyond its outlet 22, liquid fuel will be drawn upwardly through conduit 80 from the reservoir 30. Because the check valve 302 blocks flow of this gaseous fuel in the direction identified by arrows B in FIG. 4 and the bypass conduit 300 is the sole flow path around the pump 20, this process can continue until the pump 20 is primed with liquid fuel. As the conduit between the pump 20 and fuel rail 16 fills with liquid fuel, further operation of the pump 20 will increase the pressure of the liquid fuel much more quickly and will enable the check valve 302 to bypass liquid fuel around the pump 20 when the predetermined pressure setting of the check valve 302 is exceeded. As a result, the pump 20 is able to draw gaseous fuel vapor through conduit 80 during startup procedures, but the normal operation of the pump 20 in conjunction with its bypass conduit 300 will not be adversely affected.

With continued reference to FIG. 4, an additional filter 320 is illustrated within the fuel reservoir 30 and an optional filter 324 is illustrated between the pump 20 and the fuel rail 16 and filter 323 is shown between the pump 20 and check valve 311. It should be understood that these filters and their location with respect to the pump 20 are not limiting to the scope of the present invention.

With continued reference to FIGS. 1-4, it can be seen that a fuel system for a marine propulsion device made in accordance with a preferred embodiment of the present invention, comprises a fuel rail 16 connected in fluid communication with a plurality of fuel injectors, a fuel pump 20 having an outlet 22 connected in fluid communication with the fuel rail 16, an inlet 24 of the fuel pump 20 being connectable in fluid communication with a fuel reservoir 30 of a marine vessel which is displaced from the fuel pump, as illustrated by arrow H in FIGS. 1 and 4. A preferred embodiment of the present invention also comprises a bypass conduit 300 connected in selective fluid communication between the outlet 22 and inlet 24 of the fuel pump 20. A valve 302 is disposed in fluid communication with the bypass conduit 300 between the outlet 22 and the inlet 24. The valve 302 is configured to inhibit the flow of gaseous fuel through the bypass conduit 300 from the outlet 22 to the inlet 24 and permit the flow of liquid fuel through the bypass conduit 300 from the outlet 22 to the inlet 24. In a preferred embodiment of the present invention, the valve 302 is configured to inhibit the flow of fuel through the bypass conduit 300 from the outlet 22 to the inlet 24 when the fluid pressure at the outlet 22 is not a predetermined magnitude greater than the fluid pressure at the inlet 24. This predetermined pressure is determined by the force provided by spring 310. In a preferred embodiment of the present invention, it further comprises a pressure sensor 50 connected in fluid communication with the fuel rail 16 and a controller connected in signal communication with the pressure sensor 50. The controller is configured to controlled the operating speed of the fuel pump 20 as a function of the pressure of fuel within the fuel rail 16. The controller can comprise a microprocessor 54 and the microprocessor is configured to determine a desired operating speed of the fuel pump 20 as a function of the pressure of fuel within the fuel rail 16. A motor 60 is connected in torque transmitting relation with the fuel pump 20. The controller comprises a control module 66 which is configured to receive a command signal from the microprocessor 54 which is related to a desired operating speed of the pump 20 and provide an output signal to the motor 60 which is a function of the desired operating speed. In a particularly preferred embodiment of the present invention, the fuel pump 20 is a positive displacement pump and is disposed at a higher elevation than the fuel reservoir 30, as illustrated by dimension H in FIGS. 1 and 4. The fuel system is unvented between the fuel reservoir 30 and the fuel rail 16 in a preferred embodiment.

Although the present invention has been described with particular specificity and illustrated to show a preferred embodiment, it should be understood that alternative embodiments are also within its scope.

We claim:

1. A fuel system for a marine propulsion device, comprising:

a fuel rail connected in fluid communication with a plurality of fuel injectors;

a fuel pump having an outlet connected in fluid communication with said fuel rail, an inlet of said fuel pump being connectable in fluid communication with a fuel reservoir of a marine vessel which is displaced from said fuel pump;

a pressure sensor connected in fluid communication with said fuel rail;

a controller connected in signal communication with said pressure sensor, said controller being configured to control the operating speed of said fuel pump as a function of the pressure of fuel within said fuel rail; and a bypass conduit connected in selective fluid communication between said fuel pump outlet and said fuel pump inlet.

2. The fuel system of claim 1, wherein:

said controller comprises a microprocessor configured to determine a desired operating speed of said fuel pump as a function of said pressure of fuel within said fuel rail.

3. The fuel system of claim 1, further comprising a motor connected in torque transmitting relation with said fuel pump, wherein:

said controller comprises a control module which is configured to receive a command signal from said microprocessor which is related to a desired operating speed of said pump and provide an output signal to said motor which is a function of said desired operating speed.

4. The fuel system of claim 1, wherein:

said fuel pump is a positive displacement pump.

5. The fuel system of claim 4, wherein:

said positive displacement pump is a screw pump.

6. The fuel system of claim 4, wherein:

said positive displacement pump is a gerotor pump.

7. The fuel system of claim 1, wherein:

said fuel pump is disposed at a higher elevation than said fuel reservoir.

8. The fuel system of claim 1, wherein:

said fuel system is unvented between said fuel reservoir and said fuel rail.

9. The fuel system of claim 1, wherein:

said fuel system is sealed from the atmosphere between said fuel reservoir and said fuel rail.

10. The fuel system of claim 1, wherein:

said fuel system is sealed from the atmosphere between said inlet of said fuel pump and said fuel rail.

11. A fuel system for a marine propulsion device, comprising:

a fuel rail connected in fluid communication with a plurality of fuel injectors;

a fuel pump having an outlet connected in fluid communication with said fuel rail, an inlet of said fuel pump being connectable in fluid communication with a fuel reservoir of a marine vessel which is displaced from said fuel pump, said fuel pump being the sole pump disposed between said fuel reservoir and said fuel rail, said fuel pump being a positive displacement pump, said fuel system being sealed from the atmosphere between said inlet of said fuel pump and said fuel rail;

a motor connected in torque transmitting relation with said fuel pump;

a pressure sensor connected in fluid communication with said fuel rail;

a controller connected in signal communication with said pressure sensor, said controller being configured to control the operating speed of said fuel pump as a function of the pressure of fuel within said fuel rail; and a bypass conduit connected in selective fluid communication between said fuel pump outlet and said fuel pump inlet.

12. The fuel system of claim 11, wherein:

said controller comprises a microprocessor which is configured to determine a desired operating speed of said fuel pump as a function of said pressure of fuel within said fuel rail, said controller comprising a control module which is configured to receive a command signal from said microprocessor which is related to a desired operating speed of said pump and provide an output signal to said motor which is a function of said desired operating speed.

13. A fuel system for a marine propulsion device, comprising:

a fuel rail connected in fluid communication with a plurality of fuel injectors;

a positive displacement fuel pump having an outlet connected in fluid communication with said fuel rail, an inlet of said positive displacement fuel pump being connectable in fluid communication with a fuel reservoir of a marine vessel which is displaced from said fuel pump, said fuel system being unvented between said fuel reservoir and said fuel rail;

a pressure sensor connected in fluid communication with said fuel rail;

a controller connected in signal communication with said pressure sensor, said controller being configured to control the operating speed of said positive displacement fuel pump as a function of the pressure of fuel within said fuel rail; and a bypass conduit connected in selective fluid communication between said fuel pump outlet and said fuel pump inlet.

14. The fuel system of claim 13, further comprising:

a brushless motor connected in torque transmitting relation with said positive displacement fuel pump, said controller comprising a microprocessor, said microprocessor being configured to determine a desired operating speed of said positive displacement fuel pump as a function of said pressure of fuel within said fuel rail, said controller being configured to receive a command signal from said microprocessor which is related to a desired operating speed of said pump and provide an output signal to said brushless motor which is a function of said desired operating speed, said fuel pump being a positive displacement pump.

15. The fuel system of claim 1, wherein said bypass conduit blocks flow therethrough from said fuel pump inlet to said fuel pump outlet and selectively permits flow therethrough from said fuel pump outlet to said fuel pump inlet.

16. The fuel system of claim 15, wherein said bypass conduit selectively permits flow therethrough from said fuel pump outlet to said fuel pump inlet when the pressure at said fuel pump outlet is greater than the pressure at said fuel pump inlet by a predetermined amount.

17. The fuel system of claim 11, wherein said bypass conduit blocks flow therethrough from said fuel pump inlet to said fuel pump outlet and selectively permits flow therethrough from said fuel pump outlet to said fuel pump inlet.

18. The fuel system of claim 17, wherein said bypass conduit selectively permits flow therethrough from said fuel pump outlet to said fuel pump inlet when the pressure at said fuel pump outlet is greater than the pressure at said fuel pump inlet by a predetermined amount.

19. The fuel system of claim 13, wherein said bypass conduit blocks flow therethrough from said fuel pump inlet to said fuel pump outlet and selectively permits flow therethrough from said fuel pump outlet to said fuel pump inlet.

20. The fuel system of claim 19, wherein said bypass conduit selectively permits flow therethrough from said fuel pump outlet to said fuel pump inlet when the pressure at said fuel pump outlet is greater than the pressure at said fuel pump inlet by a predetermined amount.

* * * * *